US006742207B1

(12) United States Patent
Brown

(10) Patent No.: US 6,742,207 B1
(45) Date of Patent: Jun. 1, 2004

(54) PILLOW OPTIMIZED FOR SIDE SLEEPING

(76) Inventor: Thomas W. Brown, 5811 Widmer, Shawnee, KS (US) 66216

( * ) Notice: Subject to any disclaimer, the term of this patent is extended or adjusted under 35 U.S.C. 154(b) by 0 days.

(21) Appl. No.: 10/335,014

(22) Filed: Dec. 31, 2002

(51) Int. Cl.[7] ..... A47G 9/10
(52) U.S. Cl. ..... 5/636; 5/644; 5/637
(58) Field of Search ..... 5/636, 637, 644

(56) References Cited

U.S. PATENT DOCUMENTS 3,829,917 A * 8/1974 De Laittre et al. ..... 5/636
4,432,107 A * 2/1984 Clark et al. ..... 5/636
5,018,231 A * 5/1991 Wang ..... 5/636
5,138,732 A * 8/1992 Wattie et al. ..... 5/636
5,163,194 A * 11/1992 Dixon ..... 5/636
5,926,880 A * 7/1999 Sramek ..... 5/636
6,079,066 A * 6/2000 Backlund ..... 5/636
6,408,467 B2 * 6/2002 Walpin ..... 5/636

* cited by examiner

*Primary Examiner*—Michael F. Trettel
(74) *Attorney, Agent, or Firm*—Mark E. Brown

(57) ABSTRACT

A contoured pillow includes a top, a bottom, a front, a back and opposite sides. The front slopes forwardly from bottom-to-top and changes laterally in depth from side-to-side for cradling and supporting the shoulder. A neck support extension projects upwardly from the top and front and provides enhanced neck support due to the sloping configuration of the front. The top includes a recess forming a face relief pocket, right and left jaw relief areas, right and left airways extending from the jaw relief areas to the sides and a cranial support ridge. The pillow is molded from memory foam with thermally responsive characteristic for shaping itself to a particular user in conjunction with the generally concave geometry designed to give way to a generally spherical facial structure.

13 Claims, 5 Drawing Sheets

PILLOW OPTIMIZED FOR SIDE SLEEPING

BACKGROUND OF THE INVENTION

1. Field of the Invention

The present invention relates generally to pillows, and in particular to an orthopedic pillow uniquely designed for optimally conforming to the shoulders, neck and head for improved sleeping posture.

2. Description of the Related Art

Proper sleeping posture is an important factor in maximizing the benefits of restful sleep. Conversely, improper sleeping posture tends to reduce the deep stages of sleep (i.e., R.E.M. stages) and can cause insomnia. Moreover, poor posture can lead to various dysfunctional conditions, including stiffness, fatigue, blruxism, etc. Poor sleepers often "toss-and-turn" in bed, depriving themselves and their sleep partners of a restful night's sleep.

Various "orthopedic" pillows currently on the market tend to accommodate back and/or side sleepers. However, the orthopedic alignment considerations associated with side sleeping differ considerably from those associated with back sleeping. Estimates of the percentage of people who sleep on their sides run as high as 85 percent. Therefore, accommodating this group with a pillow designed for optimizing orthopedic alignment in side sleeping posture is highly desirable.

Heretofore there has not been available a pillow designed for optimizing side sleeping with the advantages and features of the present invention.

SUMMARY OF THE INVENTION

In the practice of the present invention, a contoured pillow for side is provided for improved comfort and support, the elimination of pressure points, muscular-skeletal structure alignment, temporomandibular (TMJ) relief and generally more restful sleep. The pillow includes a top, a bottom, a front and opposite sides. The front is rearwardly-concave and slopes forwardly from bottom-to-top for cradling and supporting the shoulder. A neck support extension projects upwardly from the top and front and provides enhanced neck support due to the sloping configuration of the front. The top includes a recess forming a face relief pocket, right and left jaw relief areas, right and left airways extending from the jaw relief areas to the sides and a cranial support ridge. The pillow is molded from memory foam with a thermally responsive characteristic for shaping itself to a particular user.

BRIEF DESCRIPTION OF THE DRAWINGS

The drawings constitute a part of this specification and include exemplary embodiments of the present invention and illustrate various objects and features thereof.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

II. Contoured Side Sleeping Pillow 2

Figure 1:
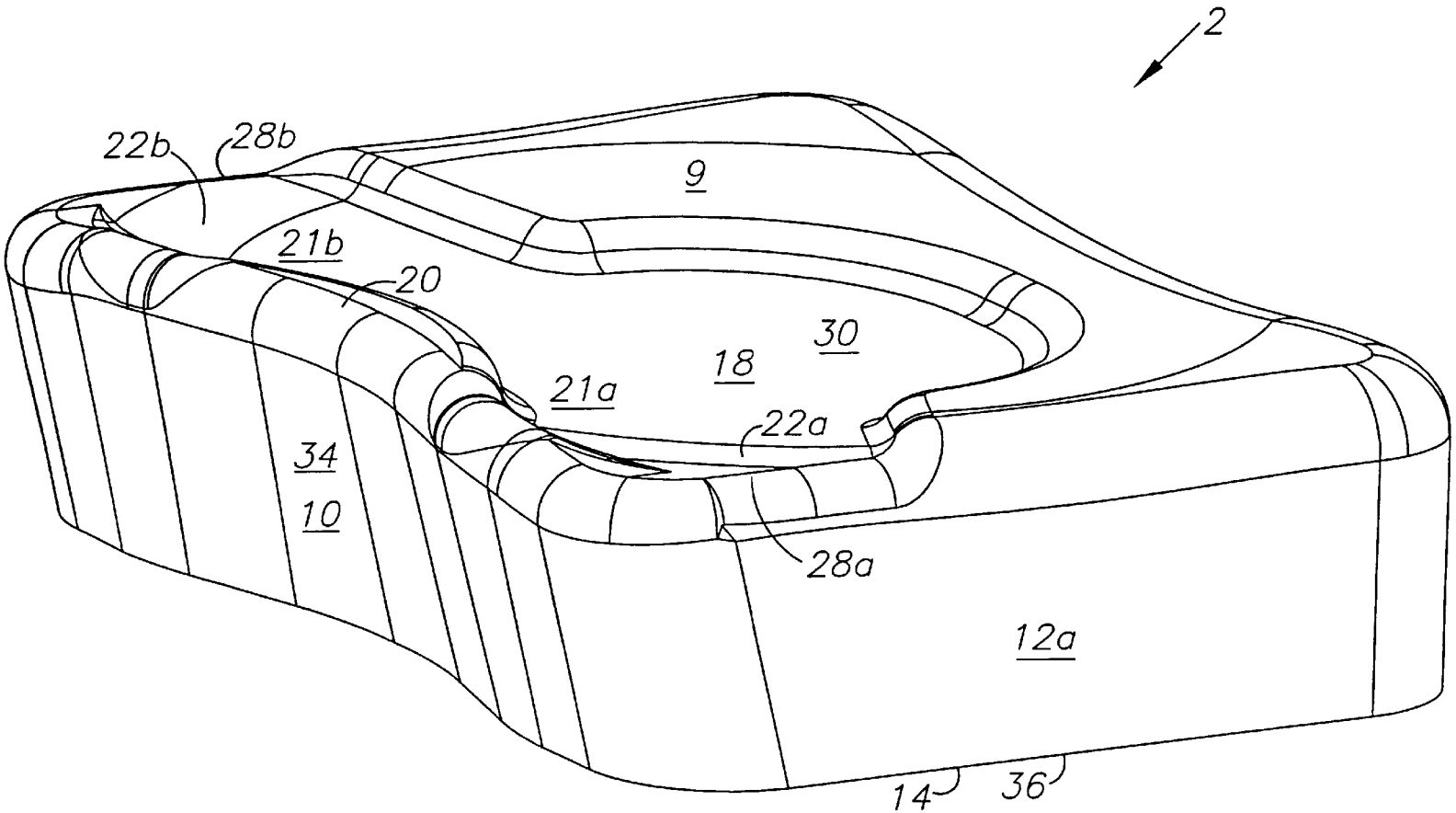
FIG. 1 is an upper, front, right side perspective view of a contoured pillow optimized for side sleeping and embodying the present invention.
Figure 2:
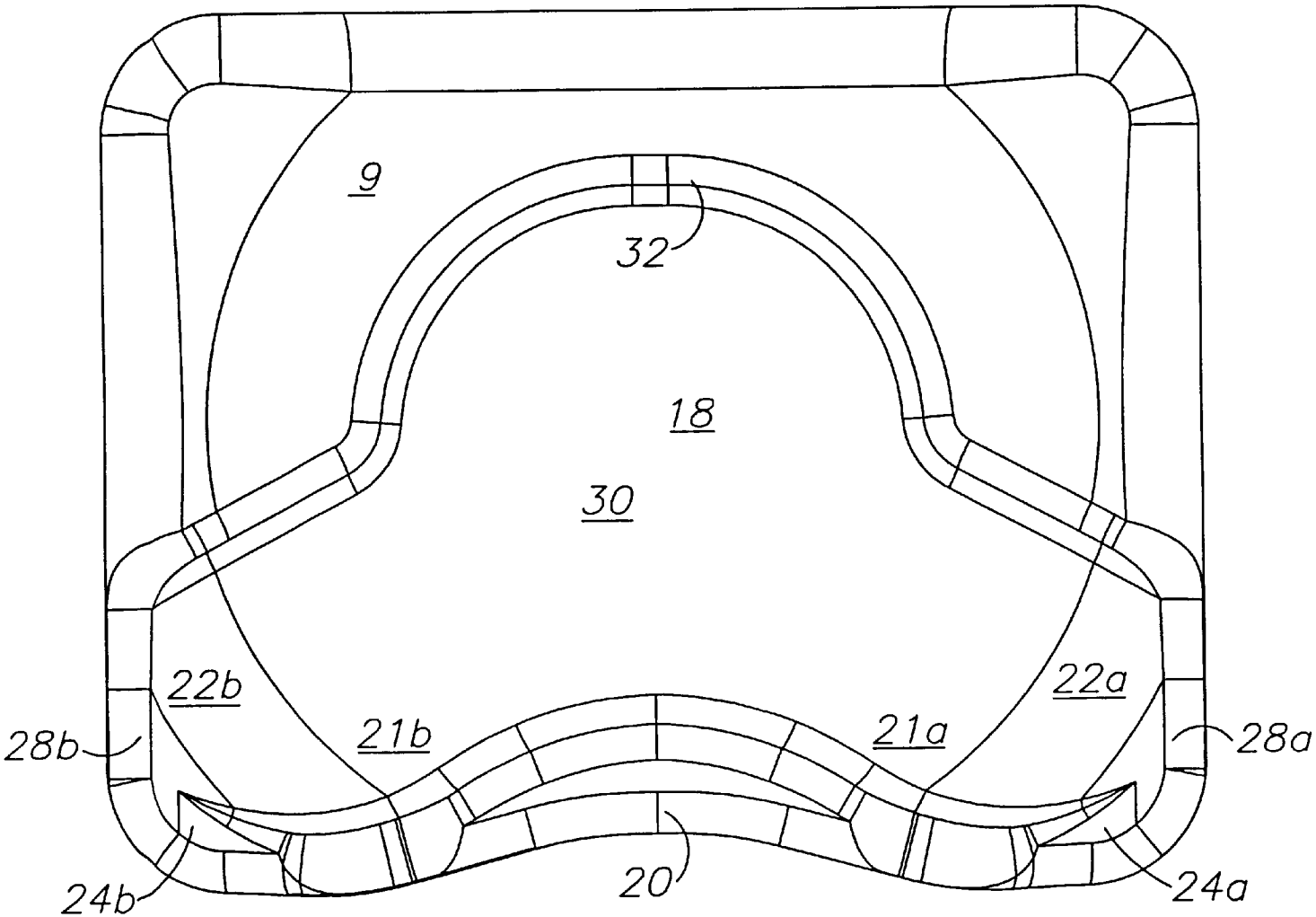
FIG. 2 is a top plan view thereof.
Figure 3:
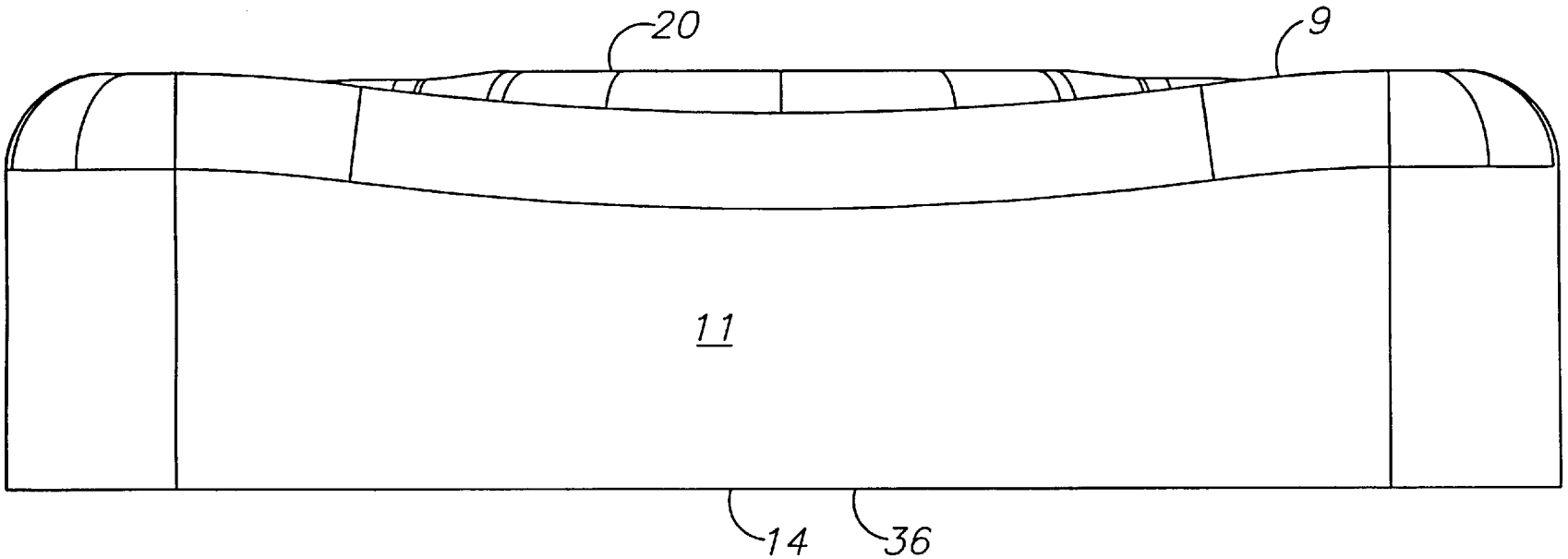
FIG. 3 is a back elevational view thereof.
Figure 4:
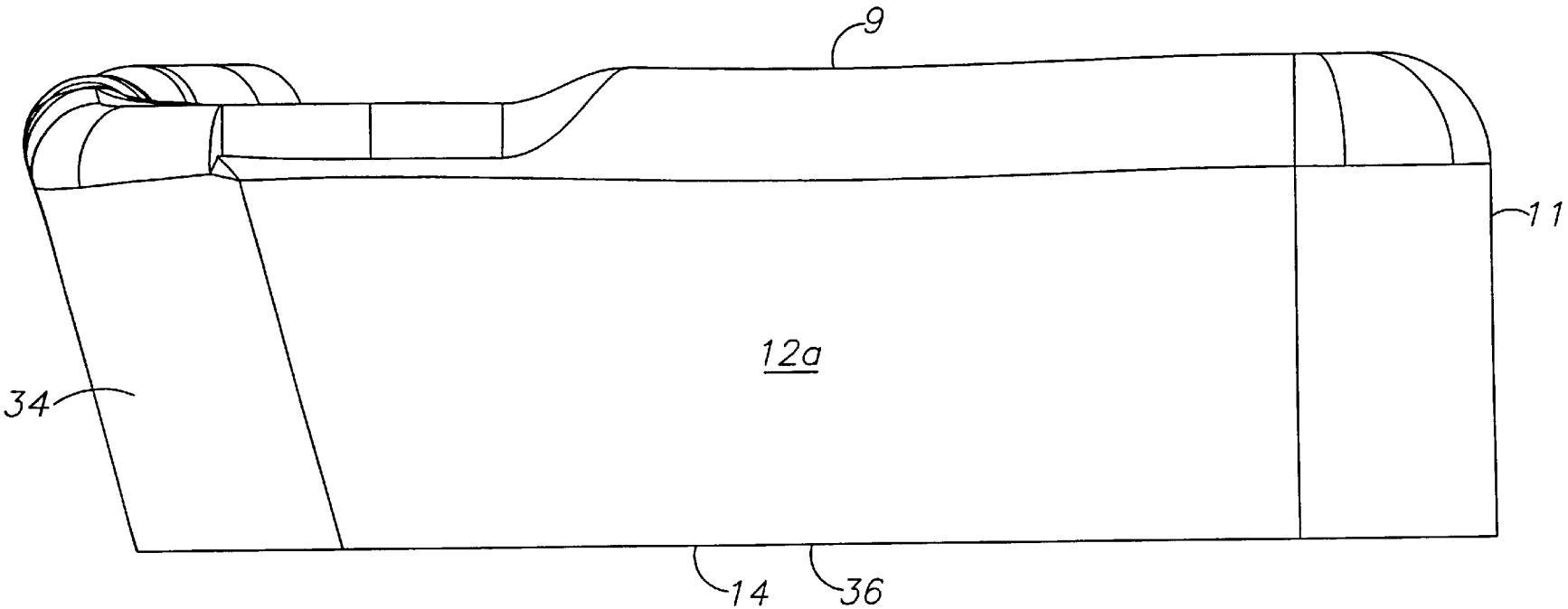
FIG. 4 is a right side elevational view thereof.
Figure 5:
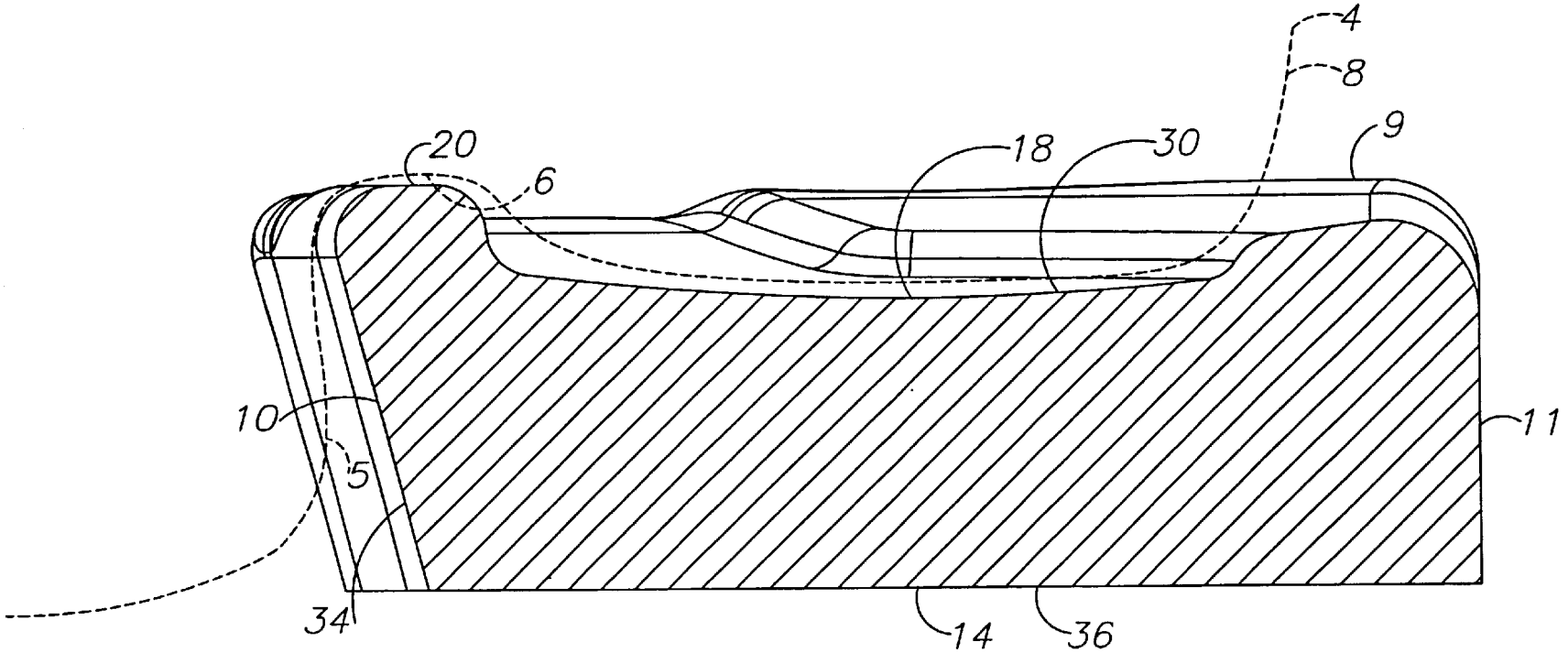
FIG. 5 is a cross-sectional view thereof, taken generally along line 5—5 in FIG. 2.

Referring to the drawings in more detail, the reference numeral 2 generally designates a contoured pillow optimized for side sleeping embodying the present invention. As shown in FIG. 5, the pillow 2 supports and aligns a user 4, particularly his or her shoulders 5, neck 6 and head 8.

The pillow 2 generally includes a contoured top 9, a sloped front 10, a back 11, right and left sides 12 *a,b* and a bottom 14. An upwardly-open top recess 18 is generally designed to receive and support the user's head 8, and includes various subparts for specific functions, as described below. The top 9 includes a raised neck support extension 20, which has a compound, upwardly-and-rearwardly convex curvature and is located adjacent to the front 10. Right and left jaw relief areas 21*a, b* are formed on either side of the neck support extension 20 and cradle the right or left side of the jaw respectively. Right and left airways 22*a,b* are formed on either side of the neck support extension 20 outboard of the jaw relief areas 21 *a,b* respectively and are generally located at right :and left front, upper corners 24*a,b*. The top 9 includes a rounded rim 26 which generally borders the recess 18 and varies in elevation to accommodate different supporting functions. The airways 22*a,b* terminate at either side 12*a,b* at respective retracted rim areas 28*a,b*, which provide passages for breathing.

A concave relief pocket 30 cradles the side of the and is generally centrally located in the recess 18 behind the neck support 20. The pocket 30 is generally shaped to accommodate the cheekbones and ears and works in conjunction with the pillow 2 to relieve pressure on the TMJ located adjacent to the ears. Behind the pocket 30 a cranial support ridge 32 is rearwardly-concave and cradles the cranial part of the head.

The front 10 forms a sloping, rearwardly-con cave front face 34 adapted to cradle and mold to a respective shoulder. This surface is designed as a complex, three-dimensional shape for optimizing support. For this purpose the front face 34 slopes forwardly with bends and curves from bottom-to-top approximately 15 degrees from the vertical. This configuration locates the rim 26, and particularly the neck support extension 20, in spaced relation forwardly from a lower rim 36 adjacent to the bottom 14.

III. Construction and Operation

The pillow 2 preferably comprises a polyurethane memory foam. Suitable foams are available from Dow Coming Corporation, Midland, Mich. 48686-0994 and Huntsman Polyurethanes of West Deptford, N.J. 08066-1732. The memory foam has the characteristic of conforming to a user under his or her body heat and pressure, which configuration is approximately retained by the foam. The pillow 2 thus conforms to each user and tends to provide greater comfort with continued use as it successively shapes itself in progressively closer approximations to the side of the user's face and his or her neck.

Maximum comfort and cervical alignment are achieved by the particular body-contouring features discussed above.

The curved, recessed front face 34 supports a substantial area of the shoulder. The forward-and-upward thrust of the neck support extension 20 extends well down the neck 6 into proximity with the shoulder 5 for maximum support area. Maximizing support area tends to reduce pressure per unit area, thus avoiding pressure points and providing even weight distribution. Such even distribution of support provides an additional benefits by avoiding loss of circulation and resulting numbness. Moreover, molding around the shoulder area provides a larger surface for the jaw relief areas 21*a,b*. The weight of the user is thus distributed over the weight-bearing shoulder, neck and head for minimizing surface unit area pressure and enhanced comfort without restricting circulation. The configuration also enhances cervical alignment by providing a relatively high level of support for the head and shoulders, which can thus more easily being maintained in proper alignment without sacrificing comfort.

The concave configuration of the face relief pocket 30 likewise tends to cradle and evenly support the entire side of the head for enhancing comfort and support for the ears, cheekbones and temporomandibular joints (TMJs). Likewise, the cranial support ridge 32 cooperates with the face relief pocket 30 to effectively cradle and support the spherical surface of the head (cranium). The cumulative effect of these specific support areas is a very comfortable, supportive, posture-aligning pillow, which produces many benefits for the user, such as more restful sleep, better posture, better breathing through the unobstructed airways 22*a,b* and TMJ benefits associated with producing or eliminating bruxism. The pillow 2 can be used to advantage with medical devices and equipment used for treating sleep apnea and other sleep disorders, particularly because of the configuration of the airways 22*a,b*.

It will be appreciated that various suitable materials can be used for forming the contoured pillow 2. The thermally-responsive "memory" foam described above his advantage of successively improving its conformity to be user. The complex, three-dimensional curvature of the pillow 2 can be produced by molding in suitable (e.g., aluminum) molds. Moreover, the recesses can be formed in the tops and bottoms of pillows according to the present invention to provide comparable comfort and posture-aligning benefits on both sides. Thus, over time the contoured pillow 2 can provide a very close fit for a user with a level of comfort not experienced with conventional pillows.

It is to be understood that while certain examples of the present invention had been described and shown herein, it is not limited thereto.

What is claimed and desired to be secured by Letters Patent is as follows:

1. A contoured pillow, which comprises:

a top, bottom, front, back and opposite sides;

a rounded, convex perimeter rim at said top;

said rim including a neck support extension extending upwardly and forwardly from said front;

said top including a top recess with a concave face relief pocket, said top recess having right and left jaw relief areas located on either side of and behind said neck support extension; and said front sloping forwardly from bottom-to-top.

2. The pillow according to claim 1, which comprises a memory foam material.

3. The pillow according to claim 2 wherein said memory foam material is heat-responsive.

4. The pillow according to claim 1, which includes said top recess having a centrally-located face relief pocket.

5. The pillow according to claim 1, which includes right and left airways extending from said right and left jaw relief areas respectively to said rim, said rim having a lowered elevation at said airways.

6. The pillow according to claim 1, which includes said top recess further including a cranial support ridge located behind said face relief pocket.

7. The pillow according to claim 1 wherein said pillow is generally symmetrical with respect to a longitudinal axis extending from front-to-back.

8. The pillow according to claim 1 wherein said bottom is generally flat.

9. The pillow according to claim 1 wherein said bottom includes a bottom recess with a concave face relief pocket.

10. A contoured pillow, which comprises:

a top, bottom, front, back and opposite sides;

a rounded, convex perimeter rim at said top;

said rim including a neck support extension extending upwardly and forwardly from said front;

said top including a top recess with a concave face relief pocket;

said top further including right and left jaw relief areas located on either side of and behind said neck support extension;

said top further including right and left airways extending from said right and left jaw relief areas respectively to said rim, said rim having a lowered elevation at said airways;

said top further including a cranial support ridge located behind said face relief pocket; and said front being rearwardly concave and sloping forwardly from bottom-to-top.

11. The pillow according to claim 10, which comprises a memory foam material.

12. The pillow according to claim 11 wherein said memory foam material is heat-responsive.

13. A contoured pillow, which comprises:

a top, bottom, front, back and opposite sides;

a rounded, convex perimeter rim at said top;

said rim including a neck support extension extending upwardly and forwardly from said front;

said top including a top recess with a concave face relief pocket; and said front defining a rearwardly-convex front wall sloping forwardly from bottom-to-top at an angle of approximately 10–20 degrees from vertical.

* * * * *